US011617428B2

(12) United States Patent
Chang

(10) Patent No.: US 11,617,428 B2
(45) Date of Patent: Apr. 4, 2023

(54) HAIR STYLING DEVICE

(71) Applicant: Stephanie Chang, Herndon, VA (US)

(72) Inventor: Stephanie Chang, Herndon, VA (US)

( * ) Notice: Subject to any disclaimer, the term of this patent is extended or adjusted under 35 U.S.C. 154(b) by 0 days.

(21) Appl. No.: 16/020,394

(22) Filed: Jun. 27, 2018

(65) Prior Publication Data

US 2019/0142130 A1 May 16, 2019

Related U.S. Application Data

(63) Continuation-in-part of application No. 15/842,873, filed on Dec. 14, 2017, now abandoned.

(60) Provisional application No. 62/584,888, filed on Nov. 12, 2017.

(51) Int. Cl.
*A45D 8/34* (2006.01)

(52) U.S. Cl.
CPC ..... *A45D 8/34* (2013.01)

(58) Field of Classification Search
CPC ... A45D 8/36; A45D 8/34; A45D 8/24; A44C 5/0053; A44C 5/0061; A44C 5/0084
USPC ..... 132/273, 245–248, 253, 278–279
See application file for complete search history.

(56) References Cited

U.S. PATENT DOCUMENTS 3,467,111 A * 9/1969 Benson ..... A45D 8/00 132/273
4,524,788 A * 6/1985 Pauldine ..... A45D 2/2478 132/250
5,293,884 A * 3/1994 Chapman ..... A45D 8/34 132/200
5,662,128 A * 9/1997 Habibi ..... A45D 2/14 132/203
5,799,672 A * 9/1998 Hansbury ..... A45D 8/34 132/247
5,833,335 A * 11/1998 Voughlohn ..... A45D 8/04 132/273
5,944,029 A * 8/1999 Brenner ..... A45D 2/18 132/203
6,079,422 A * 6/2000 Drago ..... A45D 2/2464 132/245
6,116,251 A * 9/2000 Stachowski ..... A45D 8/34 132/273
6,192,894 B1 * 2/2001 Yasuda ..... A45D 8/20 132/276

(Continued)

FOREIGN PATENT DOCUMENTS

DE 202018000066 U1 * 1/2018 ..... A45D 8/36
EP 193817 A2 * 9/1986 ..... A45D 2/32

*Primary Examiner* — Cris L. Rodriguez
*Assistant Examiner* — Brianne E Kalach
(74) *Attorney, Agent, or Firm* — WPAT, PC

(57) ABSTRACT

A hair styling device includes: a base member having two mechanical shapes stabilized by different curvature axis in a first stable state and a second stable state; a pliable holding member; and an attaching member including first and second parts coupled to the base member and the holding member, respectively, and engageable with each other for connecting the holding member to the base member. The first part of the attaching member has a first property and the second part of the attaching member has a second property. The first property and the second property are complementary to each other so that the first part and the second part are engageable with each other when encountering.

13 Claims, 19 Drawing Sheets

(56) References Cited

U.S. PATENT DOCUMENTS

| | | | | |
|---|---|---|---|---|
| 6,227,207 | B1 * | 5/2001 | Stachowski | A45D 8/00 132/273 |
| 6,578,585 | B1 * | 6/2003 | Stachowski | A45D 8/24 132/273 |
| 6,681,779 | B2 * | 1/2004 | Stachowski | A45D 8/24 132/273 |
| 7,347,019 | B1 * | 3/2008 | Shaw | F16F 1/025 40/607.01 |
| 8,757,176 | B2 | 6/2014 | Harvie | |
| 2007/0084479 | A1 * | 4/2007 | Ryan-Jakimas | A45D 2/125 132/246 |
| 2010/0065079 | A1 * | 3/2010 | Harvie | G09B 19/00 132/200 |
| 2011/0120490 | A1 * | 5/2011 | King | A45D 8/24 132/210 |
| 2014/0283551 | A1 * | 9/2014 | Ciprari | A44C 25/007 63/43 |
| 2014/0283869 | A1 * | 9/2014 | Sonstegard | A45D 8/34 132/275 |
| 2015/0020842 | A1 * | 1/2015 | Park | A45D 8/24 132/279 |
| 2015/0335122 | A1 * | 11/2015 | Wright | A45D 8/34 132/273 |
| 2015/0351515 | A1 * | 12/2015 | Harvie | A45D 8/14 132/200 |
| 2016/0106192 | A1 * | 4/2016 | Swartz | A45D 8/36 132/275 |
| 2016/0367002 | A1 * | 12/2016 | Kraszewski | A45D 2/127 |
| 2017/0112252 | A1 * | 4/2017 | Campbell | A45D 8/36 |
| 2019/0133288 | A1 * | 5/2019 | Corra | A45D 2/001 |

* cited by examiner

HAIR STYLING DEVICE

CROSS-REFERENCE TO RELATED APPLICATIONS

The present application is a continuation-in-part application claiming benefit from a parent U.S. patent application bearing a Ser. No. 15/842,873 and filed Dec. 14, 2017, which is a non-provisional application claiming benefit from a U.S. Provisional Patent Application bearing a Ser. No. 62/584,888 and filed Nov. 11, 2017. Contents of the parent application and provisional application are incorporated herein for reference.

FIELD OF THE INVENTION

The present invention relates to a hair styling device. More particularly, the instant invention relates to a hair styling device containing two configurations of stable mechanical shapes, such that the hair styling device is capable of physical transformation to hold and retain a bundle of received hair in a desired style.

BACKGROUND OF THE INVENTION

U.S. Pat. No. 6,116,251 (hereafter '251 patent), which is entitled "Spring Strip Hair Clip", comprises a carbon spring steel strip 1001 and an elastic strip 1002, as shown in FIG. 1A. The elastic strip 1002 is to hold hair against the carbon spring steel strip 1001 when the carbon spring steel strip 1001 coils into a closed position. The elastic strip 1002 can be stretched away from the carbon spring steel strip 1001 to allow space for hair to be placed between the carbon spring steel strip 1001 and the elastic strip 1002. However, the elastic strip 1002 can also extend too far from the carbon spring steel strip 1001 and not remain in alignment when hair weighs the device down, such that the Spring Strip Hair Clip does not hold the entered hair securely while rolling it up and snapping it into a top knot, low bun or updo hair style.

In another embodiment described in the '251 patent, wherein a flexible attachment member 1003 connects an end of the first strip to an end of the second strip as shown in FIG. 1B, the problem is that the flexible attachment of the two strips allows movement of the strips relative to each other in all three axis of motion making the securing of the bundle of hair while maintaining the alignment of the two strips cumbersome for the user.

U.S. Pat. No. 8,757,176 B2 (i.e. hereafter '176 patent), which is entitled "Hair Accessory and Method Styling Hair" comprises two pieces of metallic members 1004 and 1005 as shown in FIG. 1C. Those two pieces of metallic members 1004 and 1005 are fixedly attached to each other at one longitudinal end via a rivet 1006, and are free and unattached to each other at the other longitudinal end for receiving a bundle of hair from the opening 1007. To use the hair accessory, the two pieces of metallic members 1004 and 1005 must be lined up and manually closed at the unattached end after hair inserted for styling. It is cumbersome to insert hair, manually close and then compel both bistable strips to simultaneously snap to their second stable state. Moreover, hair might become disordered when finally inserted and positioned.

SUMMARY OF THE INVENTION

The invention thus provides a hair styling device, which is easily operable.

The invention also provides a hair styling device, which can smooth hair while styling it.

In an aspect of the invention, a hair styling device includes: a) a base member having two mechanical shapes stabilized by different curvature axis in a first stable state and a second stable state, wherein in the first stable state, the base member has a linear structure including a concave surface, a convex surface and two longitudinal ends, and having a curved ridge around a longitudinal axis connecting the two longitudinal ends, and in the second stable state, the base member has at least one wrap-around cylindrical structure and coiled around a lateral axis substantially perpendicular to the longitudinal axis; b) a holding member made of a pliable material; and c) an attaching member including a first part coupled to the base member and a second part coupled to the holding member, and the first part and the second part are engageable with each other for connecting the holding member to the base member; whereby the hair is styled by being inserted between the base member and the holding member while the base member is in the first stable state, then being rolled together with the base member and the holding member until a desired configuration is achieved, and then being fixed in response to an external force applied to the convex surface of the base member to transform the base member into the second stable state, and wherein the first part of the attaching member has a first property and the second part of the attaching member has a second property, and the first property and the second property are complementary to each other so that the first part and the second part are engageable with each other when encountering.

In an embodiment, the first part and the second part of the attaching member include different ones of hook posts and loop posts, which are engageable with each other. In another embodiment, the first part and the second part of the attaching member include magnetic pieces of different polarities, which are engageable with each other.

In an embodiment, the first part of the attaching member is attached onto the base member at one or both of the two longitudinal ends, and the second part of the attaching member is attached onto the holding member at one or both of longitudinal ends corresponding to the two longitudinal ends of the base member. In another embodiment, the first part of the attaching member is attached onto at least a longitudinal side of the base member, and the second part of the attaching member is attached onto at least a longitudinal side of the holding member.

In an embodiment, the first part and the second part of the attaching member are respectively attached onto a surface of the base member and a surface of the holding member, which are facing each other. In another embodiment, the first part and the second part of the attaching member are respectively attached onto a first surface of the base member, and a first surface of the holding member, and the holding member is longer than the base member and wraps over one or both of the longitudinal ends of the base member to have the first part and the second part engage with each other at the first surface of the base member.

In another aspect of the present invention, a hair styling device, comprising: a base member, a holding member and an attaching member. The base member has two mechanical shapes stabilized by different curvature axis in a first stable state and a second stable state, wherein in the first stable state, the base member has a linear structure including a concave surface, a convex surface and two longitudinal ends, and having a curved ridge around a longitudinal axis connecting the two longitudinal ends, and in the second stable state, the base member has at least one wrap-around cylindrical structure and coiled around a lateral axis substantially perpendicular to the longitudinal axis. The holding member also has two mechanical shapes stabilized by different curvature axis in a third stable state and a fourth stable state, wherein in the third stable state, the holding member has a linear structure including a concave surface, a convex surface and two longitudinal ends, and having a curved ridge around a longitudinal axis connecting the two longitudinal ends, and in the fourth stable state, the holding member has at least one wrap-around cylindrical structure and coiled around a lateral axis substantially perpendicular to the longitudinal axis. The attaching member includes a first part coupled to the base member and a second part coupled to the holding member, and the first part and the second part are engageable with each other for connecting the holding member to the base member. Hair is styled by being inserted between the base member and the holding member while the base member and the holding member are in the first and third stable states, respectively, then being rolled together with the base member and the holding member until a desired configuration is achieved, and then being fixed in response to an external force applied to the convex surface of the base member to transform the base member into the second stable state. The first part of the attaching member has a first property and the second part of the attaching member has a second property, and the first property and the second property are complementary to each other so that the first part and the second part are engageable with each other when encountering.

DETAILED DESCRIPTION OF THE PREFERRED EMBODIMENTS

A hair styling device that easily and securely maintains a wearer's hair in a decorative and/or functional configuration is provided. The presently disclosed technology comprises the hair styling device for receiving and retaining a bundle of hair into a desired style, like a bun, ponytail or other.

Figure 1A:
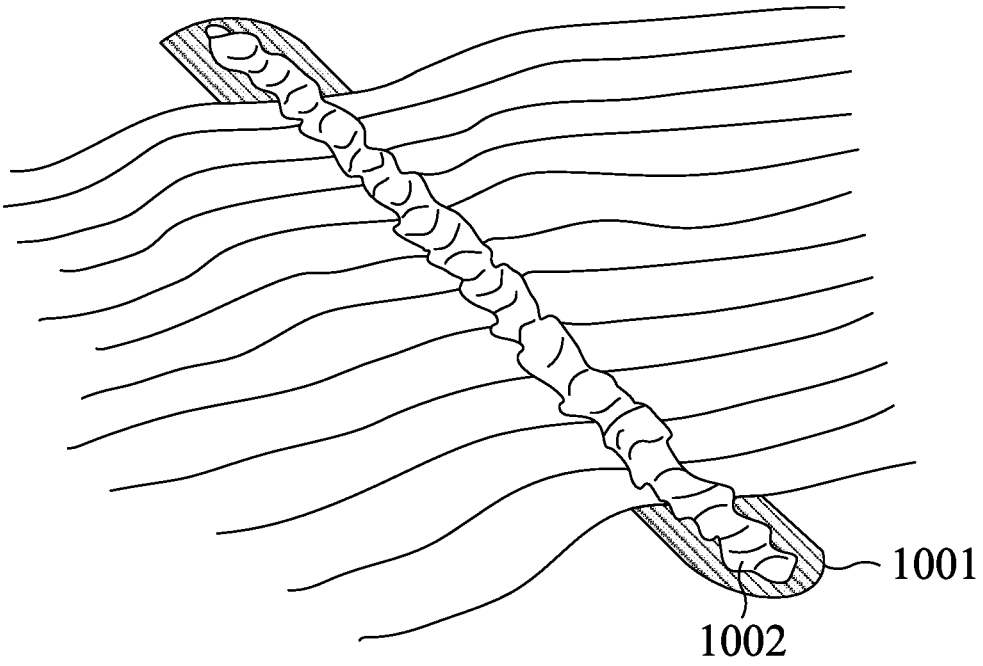
FIG. 1A (PRIOR ART)
FIG. 1A is a schematic diagram illustrating a hair styling device according to a prior art.
Figure 1B:
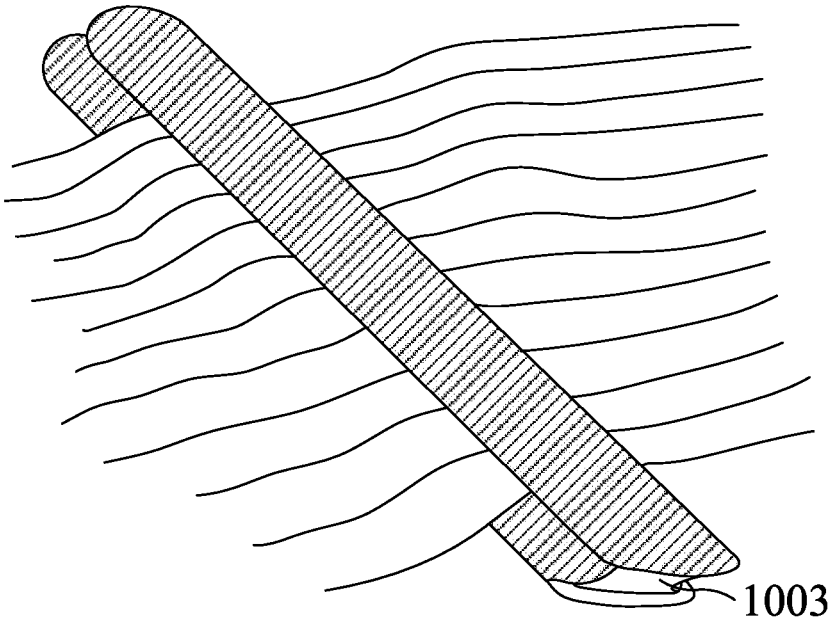
FIG. 1B (PRIOR ART)
FIG. 1B is a schematic diagram illustrating a hair styling device according to another prior art.
Figure 1C:
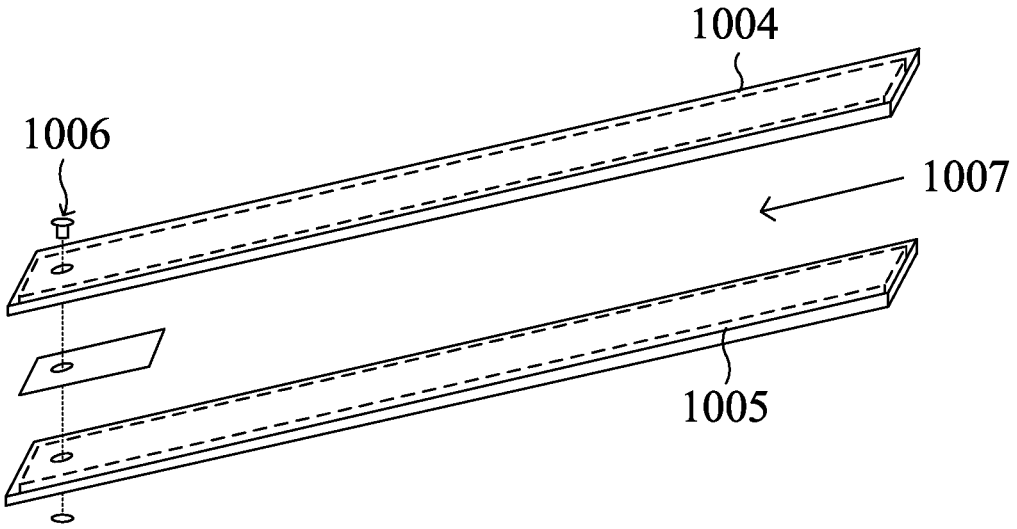
FIG. 1C (PRIOR ART)
FIG. 1C is a schematic diagram illustrating a hair styling device according to a further prior art.
Figure 2A:
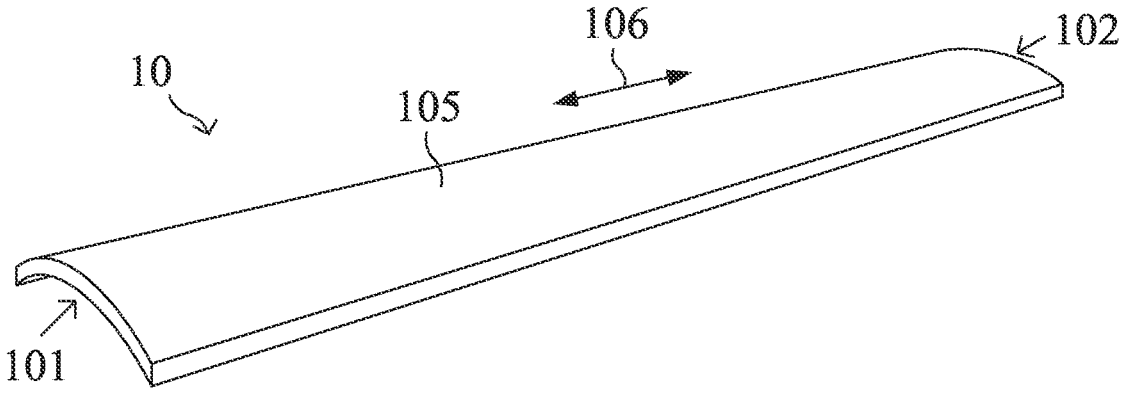
FIG. 2A is a perspective view schematically illustrating a structure of a base member included in a hair styling device according to the invention, wherein the base member is in a linear structure in a first stable state.
Figure 2B:
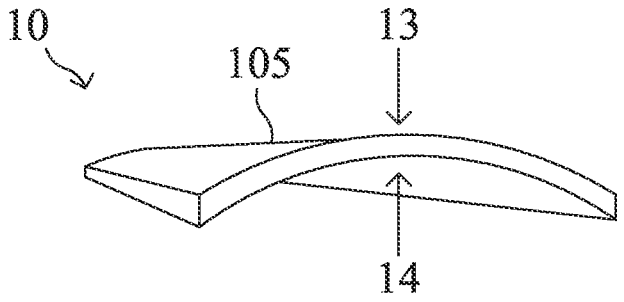
FIG. 2B is another perspective view schematically showing the base member illustrated in FIG. 2A in the first stable state.
Figure 2C:
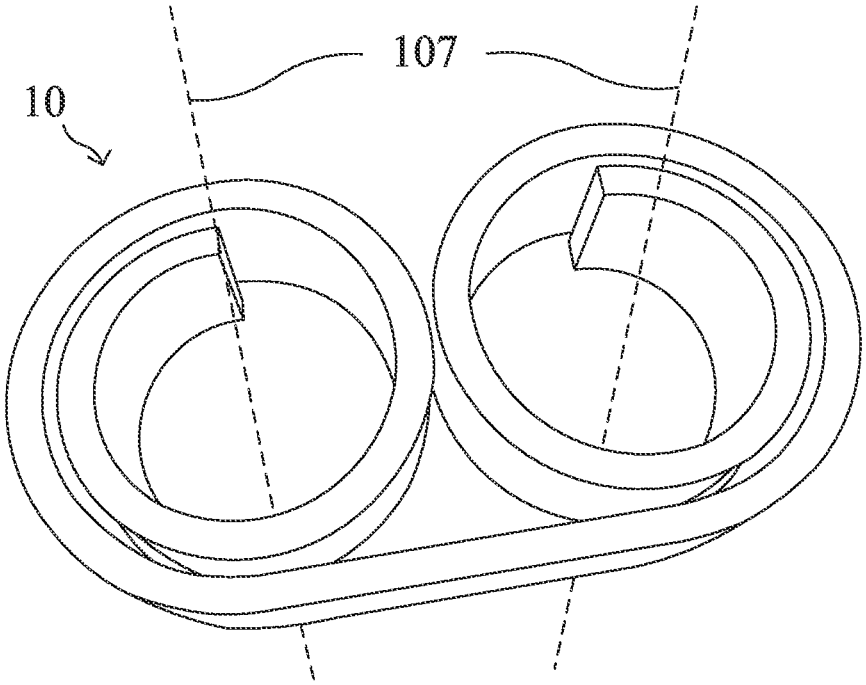
FIG. 2C is a perspective view schematically illustrating a structure of a base member included in a hair styling device according to the invention, wherein the base member is in a two-cylindrical structure in a second stable state.
Figure 2D:
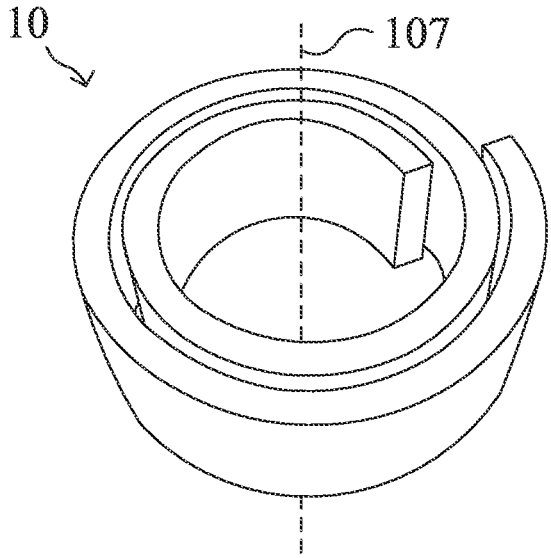
FIG. 2D is a perspective view schematically illustrating a structure of a base member included in a hair styling device according to the invention, wherein the base member is in a wraparound structure in the second stable state.

The hair styling device according to the present invention includes a base member, a holding member and an attaching member, which will be respectively described hereinafter by way of a variety of embodiments and examples with reference to the accompanying drawings. Referring to FIG. 2A and FIG. 2B, a thin strip 10 is used as an embodiment of the base member, and has two mechanical shapes stabilized by different curvature axes. A first stable state where the base member 10 is a linear structure with a curved ridge 105 extending in a longitudinal direction 106, such that the base member 10 has a concave surface 14, a convex surface 13 and two longitudinal ends 101 and 102. A second stable state where the base member has at least one wrap-around cylindrical structure coiled around lateral axis 107 where the curved ridge 105 disappears, as shown in FIG. 2C and FIG. 2D. The first stable state transforms into the second stable state when at least one point of pressures is applied on the convex surface 13 of the base member 10. The base member 10 can be reconfigured from the second stable state back to the first stable state by physically unraveling and straightening the base member 10. The base member 10 is made of any material with at least two stable physical states including one selected from the group consisting of engineering materials, steel, alloy, iron, aluminum, tin, foam skin, plastic and carbon fiber and similar.

The base member 10 may be of varying thickness, width and length to both adapt to the specific material of which it is made and to accommodate different volumes or textures of hair.

The holding member 20 is preferably pliable. When in use with the base member 10 in the first stable state, the holding member 20 has a pair of ends 201 and 202. In this position, the holding member 20 is opposed to the concave surface 14 of the base member 10 and is capable of physical transformation to accommodate the transition of the base member 10 to, and from, the first and the second stable states. In an embodiment, the material of the holding member 20 may, but not necessarily, be non-metallic, for example, fabric (e.g. mesh, legging material, vinyl, nylon and spandex), silicone, plastic, rubber, flannel woven, plush, sequin, velvet, silk, polyester, nylon, satin, PVC prismatic reflective sheet, vinyl, polyethylene, polythene, leather and other similar material.

Figure 3A:
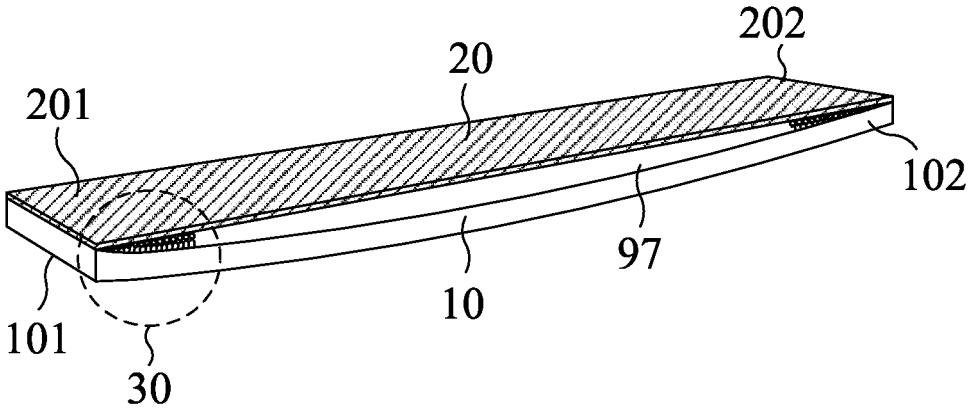
FIG. 3A is a schematic diagram which illustrates a hair styling device according to an embodiment of the present invention.
Figure 3B:
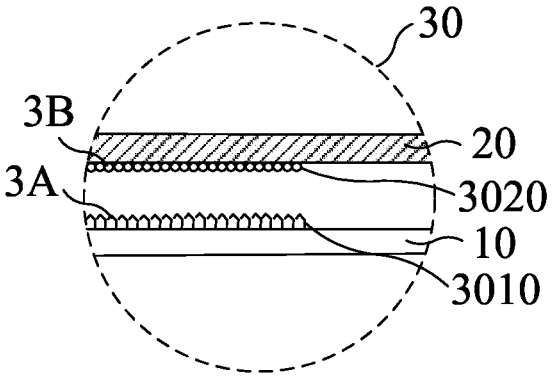
FIG. 3B is a partially enlarged view of an embodiment of an attaching member included in the hair styling device shown in FIG. 3A.
Figure 3C:
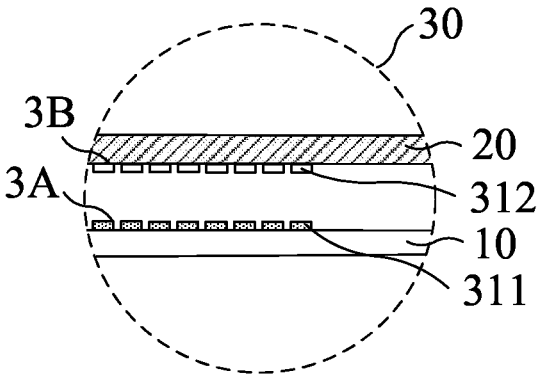
FIG. 3C is a partially enlarged view of another embodiment of an attaching member included in the hair styling device shown in FIG. 3A.

An embodiment of the attaching member 30 is schematically illustrated in FIG. 3A, which includes a first part 3A and a second part 3B wherein the first part 3A is directly formed on or mounted to the base member 10 at two opposite ends 101 and 102 of the base member 10, respectively, and the second part 3B is directly formed on or mounted to the holding member 20 at two opposite ends 201 and 202 of the holding member 20, respectively. FIG. 3B schematically illustrates a partially enlarged view of the attaching member 30 disposed at one end of the base and holding member assembly, wherein the first part 3A includes a plurality of hook posts 3010 and the second part 3B includes a plurality of loop posts 3020. The first part 3A and the second part 3B may be fixed onto the base member 10 and the holding member 20 by way of glue, press or any other laminating means, or integrally formed therewith. In an alternative embodiment, the first part 3A includes a magnetic set 311 of a first polarity, e.g. N pole, and the second part 3B includes a magnetic set 312 of a second polarity, e.g. S pole, attractive to the magnetic set of the first polarity, as illustrated in FIG. 3C. Each the magnetic sets 311 and 312 may include one or more magnetic pieces, and is mounted to the base member 10 and holding member 20 in selected ways suitable for the materials of the base member 10 and holding member 20. It is to be noted that, if the base member 10 is made of a metallic material or includes a metallic portion there, the magnetic set 311 can be omitted, and the magnetic set 312 can be directly coupled to the metallic base member 10.

Figure 3D:
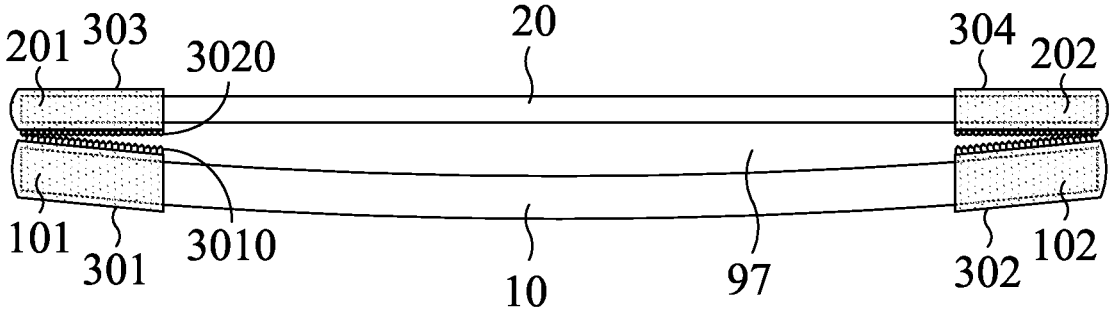
FIG. 3D is a side view schematically illustrating an alternative example of the hair styling device as shown in FIG. 3A.

FIG. 3D schematically exemplifies how the first part 3A and the second part 3B are coupled to the base member 10 and holding member 20 if the first part 3A and the second part 3B of the attaching member 30 cannot be directly formed on the base member 10 and the holding member 20.

In this embodiment, the first part 3A includes a first sleeve 301 and a second sleeve 302 put on the first end 101 and second end 102 of the base member 10, and the second part 3B includes a third sleeve 303 and a fourth sleeve 304 put on the first end 201 and second end 202 of the holding member 20, respectively. By combining the first sleeve 301 with the third sleeve 303 and combining the second sleeve 302 and the fourth sleeve 304, the base member 10 and the holding member 20 can be integrated with jointed longitudinal ends. In this embodiment, the first part 3A further includes a plurality of mini-posts which have a first kind of curved ends, e.g. hook posts 3010, formed on the first sleeve 301 and the second sleeve 302, and the second part 3B includes a plurality of mini-posts which have a second kind of curved ends, e.g. loop posts 3020, formed on the third sleeve 303 and the fourth sleeve 304, wherein the hook posts 3010 and the loop posts 3020 are engageable with each other when encountering, and detachable from each other when opposite-directional forces are exerted to separate them. With the engagement of the hook posts 3010 and the loop posts 3020, ends 201 and 202 of the holding member 20 can be connected with ends 101 and 102 of the base member 10, respectively, to form a closed loop. Hair can be inserted into a space 97 formed inside of the loop and rolled up to be styled. Since the hook posts 3010 and the loop posts 3020 are repeatably engageable with and detachable from each other, hair can be placed onto one of the base member 10 and holding member 20 first, and the other of the base member 10 and holding member 20 is stacked onto the base member 10 and holding member 20 with hair to have the first part 3A and the second part 3B engage with each other so as to complete the assembly. Afterwards, hair can be rolled up as desired. Likewise, the hook posts 3010 and the loop posts 3020 may be replaced with magnetic sets 311 and 312 with different polarities, which attract each other when encountering, and the magnetic set 311 can be omitted if the base member is made of a metallic material or includes a metallic portion to couple to the magnetic set 311.

Figure 4A:
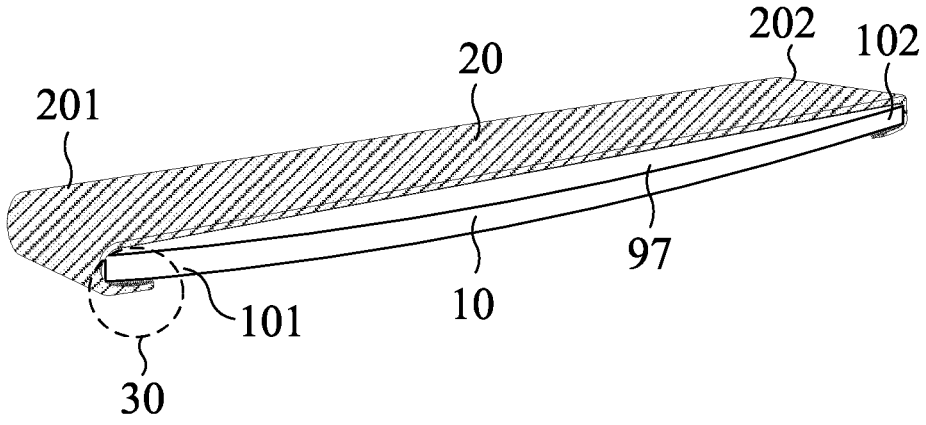
FIG. 4A is a schematic diagram which illustrates a hair styling device according to another embodiment of the present invention.
Figure 4B:
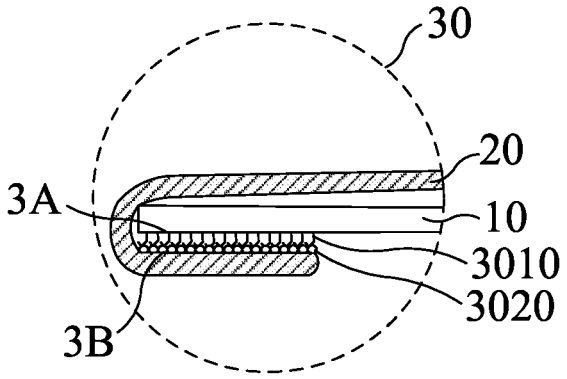
FIG. 4B is a partially enlarged view of an embodiment of an attaching member included in the hair styling device shown in FIG. 4A.
Figure 4C:
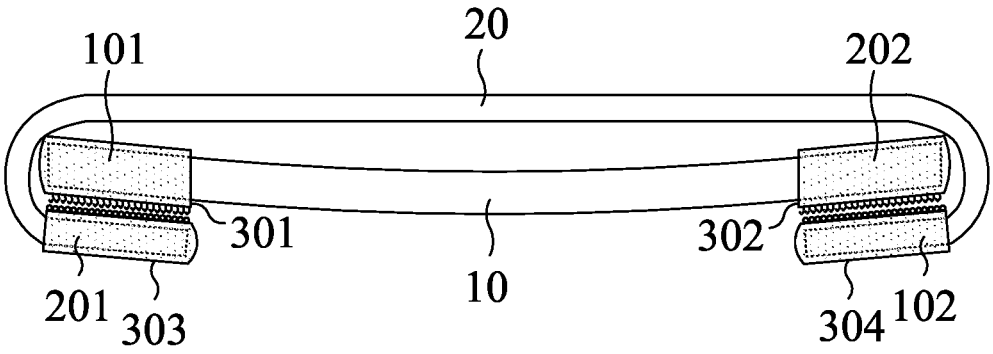
FIG. 4C is a side view schematically illustrating an alternative example of the hair styling device as shown in FIG. 4A.

In the above embodiments, the hook posts 3010 and the loop posts 3020 face each other to be engaged when assembling. In other embodiments as illustrated in FIGS. 4A, 4B and 4C, which have basic structures similar to those shown in FIGS. 3A, 3B and 3D, respectively, the hook posts 3010 are formed on the convex surface 13 of the base member 10, and the loop posts 3020 formed on the holding member 20 face the convex surface 13 of the base member 10. By having the holding member 20 longer than the base member 10 and wraps over the longitudinal ends 101 and 102 of the base member 10, the first part 3A and the second part 3B may engage with each other at the convex surface 13 of the base member 10. In this way, the space 97 is maximized as the entire longitudinal length of the base member 10 is available to hold hair. Likewise, the hook posts 3010 and the loop posts 3020 may be replaced with magnetic sets 311 and 312 with different polarities, which attract each other when encountering, and the magnetic set 311 can be omitted if the base member is made of a metallic material or includes a metallic portion to couple to the magnetic set 311.

Figure 5A:
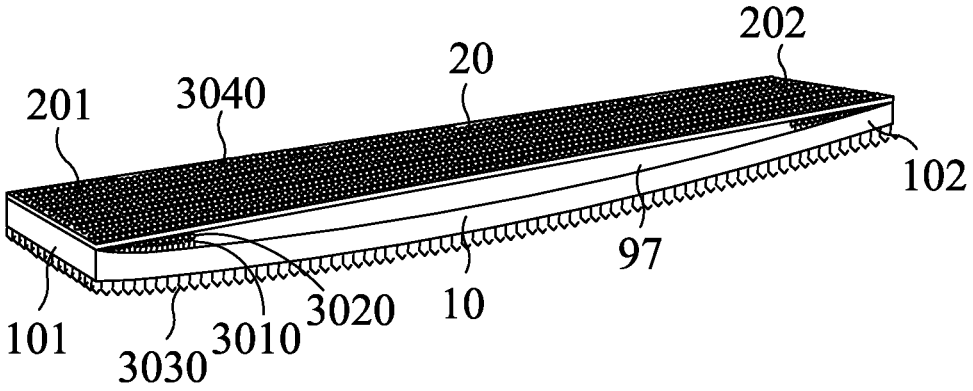
FIG. 5A is a schematic diagram which illustrates a hair styling device according to a further embodiment of the present invention.
Figure 5B:
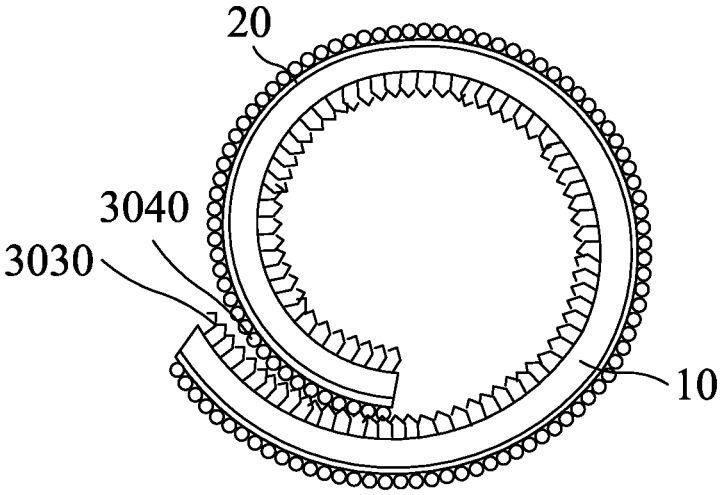
FIG. 5B is a side view schematically illustrating the hair styling device of FIG. 5A, which has a securing member for securing the second stable state where the base member has a wrap-around cylindrical structure coiled around lateral axis where the curved ridge disappears.

Please refer to FIG. 5A and FIG. 5B. FIG. 5A is a schematic diagram which illustrates a hair styling device according to a further embodiment of the present invention; and FIG. 5B is a side view schematically illustrating the hair styling device of FIG. 5A, which has a securing member for securing the second stable state where the base member has a wrap-around cylindrical structure coiled around lateral axis where the curved ridge disappears. In this embodiment, a plurality of hook posts 3030 are provided onto the convex surface 13 of the base member 10, and a plurality of loop posts 3040 are provided onto the surface of the holding member 20 facing away from the base member 10, collaboratively serving as a securing member. With the hook posts 3030 and the loop posts 3040, a hook-and-loop fastening function can be performed for securing the second stable state where the base member has a wrap-around cylindrical structure coiled around lateral axis where the curved ridge disappears. It is understood by those skilled in the art, the hook posts 3030 and loop posts 3040 may be exchanged, or alternatively, hybridized or arranged in patches, as long as the hook-and-loop fastening purpose can be achieved. Furthermore, the hook-and-loop fastener is merely an example of the securing member, and may be replaced with other engaging/disengaging means, e.g. magnetic sets with different polarities.

Figure 6A:
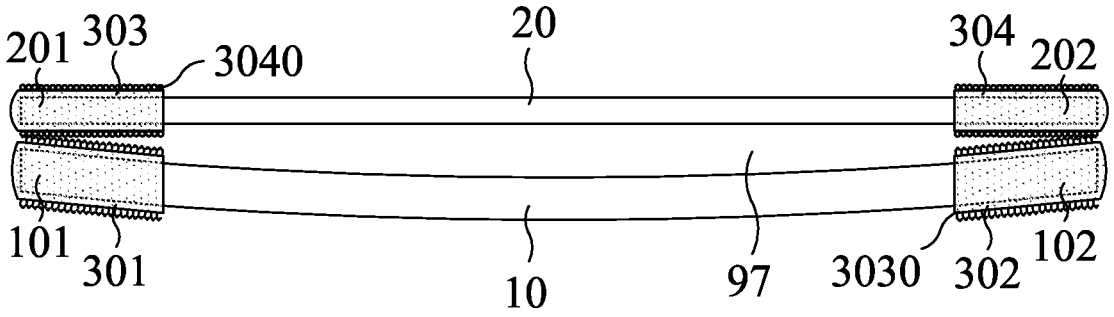
FIG. 6A is a schematic diagram which illustrates a hair styling device according to a further embodiment of the present invention.
Figure 6B:
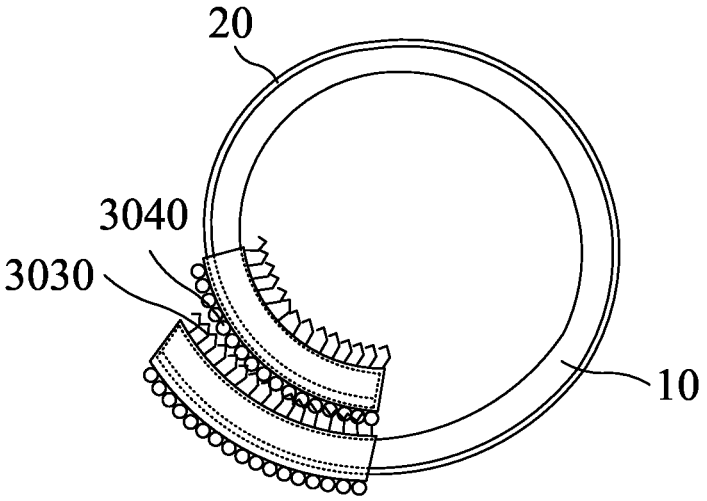
FIG. 6B is a side view schematically illustrating the hair styling device of FIG. 6A, which has a securing member for securing the second stable state where the base member has a wrap-around cylindrical structure coiled around lateral axis where the curved ridge disappears.
Figure 6C:
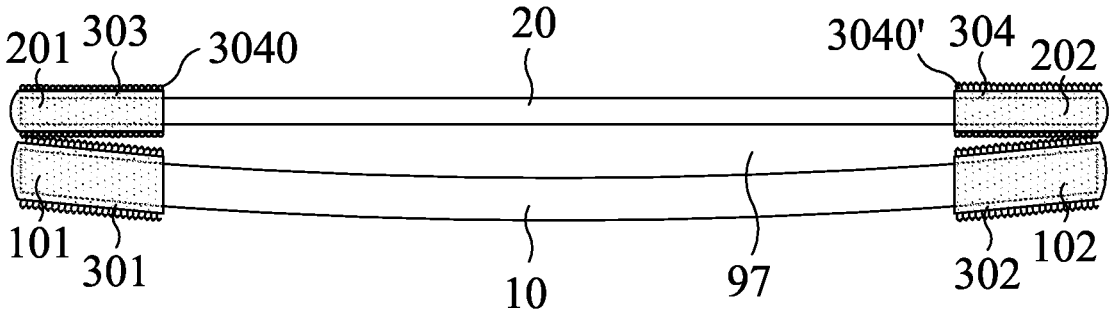
FIG. 6C is a schematic diagram which illustrates a hair styling device according to still a further embodiment of the present invention.
Figure 6D:
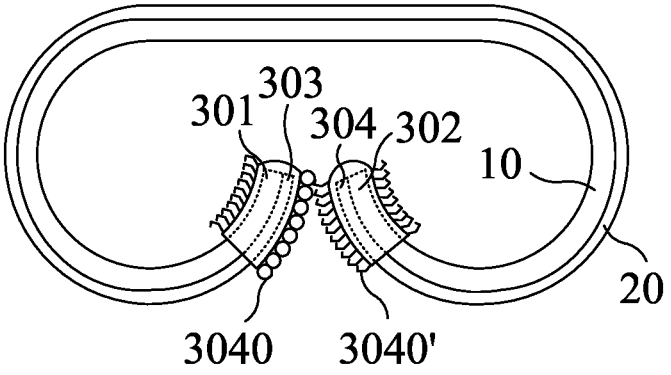
FIG. 6D is a side view schematically illustrating the hair styling device of FIG. 6C, which has a securing member for securing the second stable state where the base member has two wrap-around cylindrical structure coiled around lateral axis where the curved ridge disappears.

Likewise, as shown in FIG. 6A and FIG. 6B, by properly arranging hook/loop posts 3030 and 3040 on the sleeves 301, 302, 303 and 304, the second stable state, where the base member 10 has a wrap-around cylindrical structure coiled around lateral axis where the curved ridge disappears, may be secured with the engagement of the hook/loop posts 3030 and 3040. Another embodiment schematically illustrated in FIG. 6C differs from that schematically illustrated in FIG. 6A in that mini-posts provided on the sleeve 304 need to be different from those provided on the sleeve 303, e.g. hook posts 3040' and loop posts 3040, so as to able to form two wrap-around cylindrical structures as schematically shown in FIG. 6D.

Figure 7A:
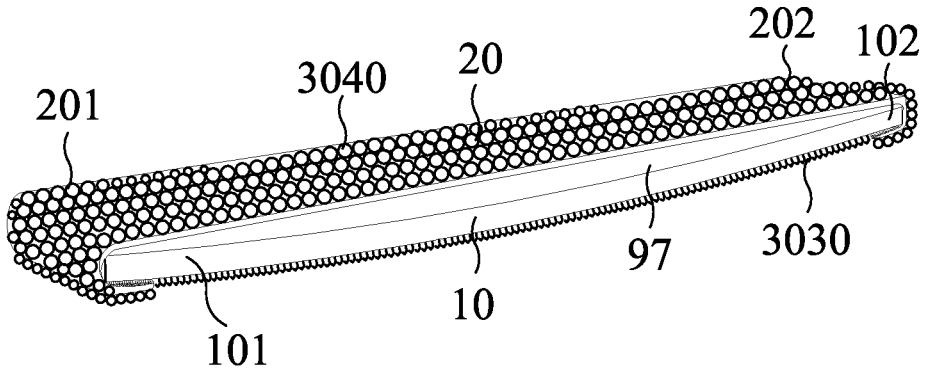
FIG. 7A is a schematic diagram which illustrates a hair styling device according to a further embodiment of the present invention.
Figure 7B:
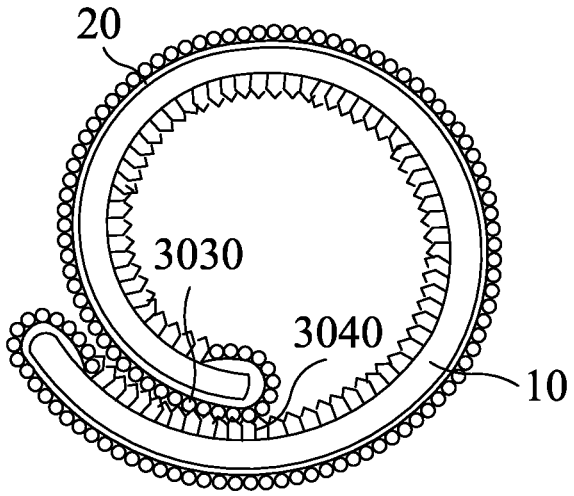
FIG. 7B is a side view schematically illustrating the hair styling device of FIG. 7A, which has a securing member for securing the second stable state where the base member has a wrap-around cylindrical structure coiled around lateral axis where the curved ridge disappears.
Figure 8A:
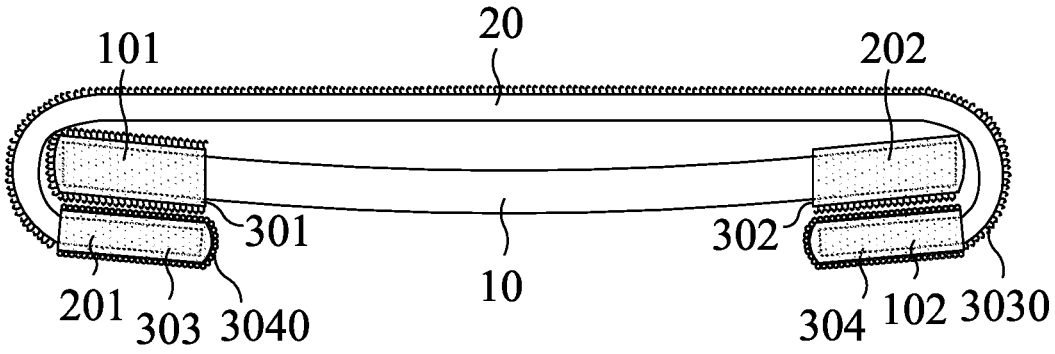
FIG. 8A is a schematic diagram which illustrates a hair styling device according to a further embodiment of the present invention.
Figure 8B:
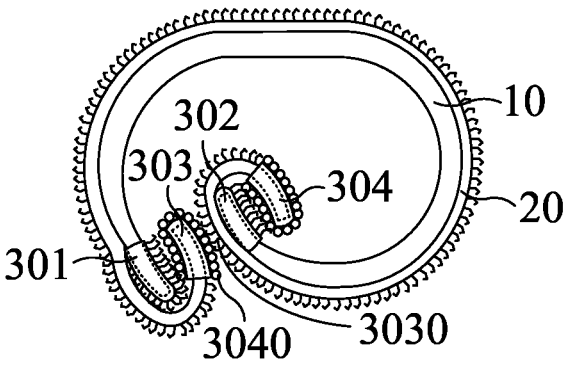
FIG. 8B is a side view schematically illustrating the hair styling device of FIG. 8A, which has a securing member for securing the second stable state where the base member has a wrap-around cylindrical structure coiled around lateral axis where the curved ridge disappears.

Similar discussion applies to the embodiment illustrated in FIG. 7A and FIG. 7B, which is modified from the embodiment illustrated in FIG. 5A, as well as the embodiment illustrated in FIGS. 8A and 8B, which is modified from the embodiment illustrated in FIG. 6. In these embodiments, a hook-and-loop fastener is also used as a securing member for securing the second stable state where the base member has the wrap-around cylindrical structure(s). Likewise, the hook-and-loop fastener is merely an example of the securing member, and may be replaced with other engaging/disengaging means, e.g. magnetic sets with different polarities.

Figure 9A:
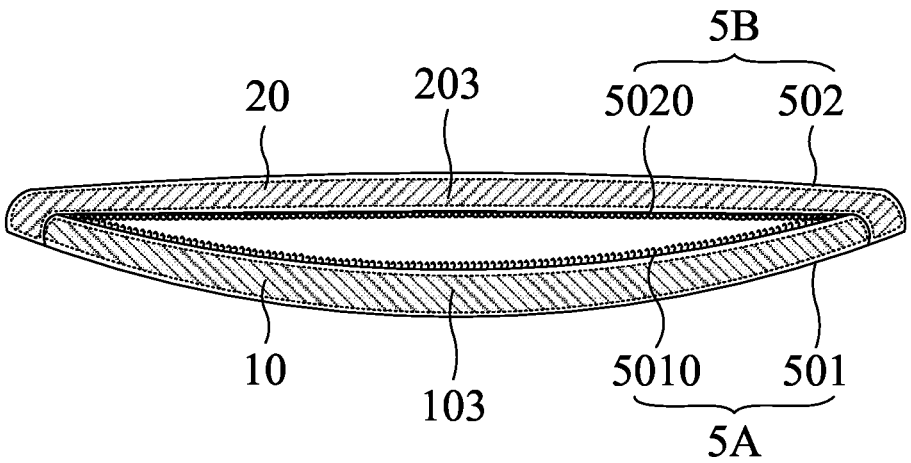
FIG. 9A is a side view schematically illustrating a hair styling device according to a further embodiment of the present invention, both ends of which are kept closed.

Please refer to another embodiment of hair styling tool according to the present invention, as illustrated in FIG. 9A. In this embodiment, the attaching member includes a first part 5A and a second part 5B, wherein the first part 5A includes a supporting base 501 formed with mini-posts 5010 and attached onto the base member 10, and the second part 5B includes a supporting base 502 formed with mini-posts 5020 and attached onto the holding member 20. The supporting base 501 is wrapped around the base member 10, and the supporting base 502 is wrapped around the holding member 20. Mini-posts 5010 are distributed on the supporting base 501 not only at positions corresponding to the longitudinal ends 101 and 102 of the base member 10 as described above, but also in a middle portion 103 of the base member 10. Likewise, the mini-posts 5020 are distributed on the supporting base 502 not only at positions corresponding to the longitudinal ends 201 and 202 of the holding member 10 as described above, but also in a middle portion 203 of the holding member 20. The first part 5A and the second part 5B are fixed to each other by connecting the supporting base 501 and the supporting base 502 at the opposite ends 101 and 102 of the base member 10 and the opposite ends 201 and 202 of the holding member 20, thereby forming a closed loop, and hair can be inserted into the space 97 from an opening of the closed loop. The first part 5A and the second part 5B can be further fixed to each other with the mini-posts 5010 and 5020 to have the middle portion 103 of the base member 10 and the middle portion 203 of the holding member 20 coupled to each other. In this embodiment, the engagement of the mini-posts 5010 and 5020 further secures hair in the space 97 in a well-distributed state, so that hair can be evenly rolled up with the base member 10 and holding member 20 to have a better styling effect. In this embodiment, the mini-posts 5010 are hook posts, and the mini-posts 5020 are loop posts. Likewise, the hook-and-loop fastener is merely an example of the attaching member, and may be replaced with other engaging/disengaging means, e.g. magnetic sets with different polarities. Since the base member 10 and the holding member 20 has already been connected together at opposite ends, the mini-posts 5010 and the mini-posts 5020 do not need to be of different types for fastening the base member 10 with the holding member 20. Instead, the curved parts of the mini-posts can interact with hair so as to smooth hair when penetrating through hair. Therefore, the mini-posts 5010 and the mini-posts 5020 may be, for example, both loop posts or both hook posts. Alternatively, either the mini-posts 5010 in the middle portion 103 of the base member 10 or the mini-posts 5020 in the middle portion 203 of the holding member 20 may be omitted. Likewise, the magnetic set arranged on the holding member 20 can be omitted if the base member 10 is made of a metallic material or includes a metallic portion to couple to the magnetic set.

In an alternative embodiment, the supporting part 5A may be integrally formed with the base member 10 and/or the second part 5B may be integrally formed with the holding member 20. In other words, the loop posts 5010 are directly formed on the base member 10 without the supporting base 501, and/or the hook posts 5020 are directly formed on the holding member 20 without the supporting base 502.

Figure 9B:
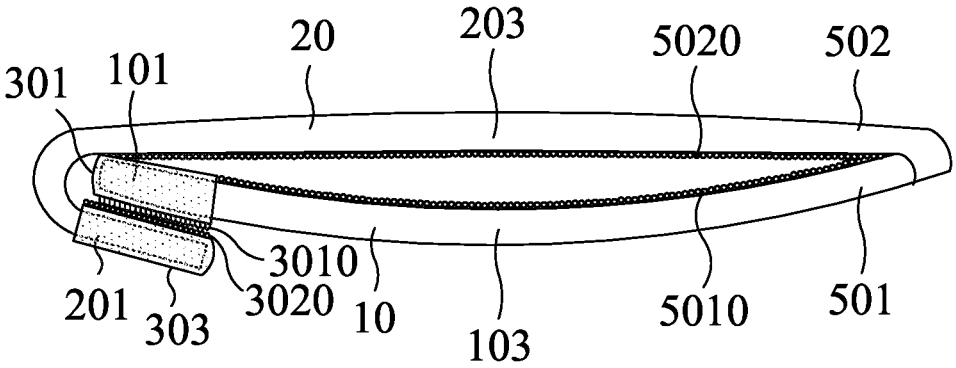
FIG. 9B is a side view schematically illustrating a hair styling device according to a further embodiment of the present invention, one end of which is kept closed, and the other end of which can be opened.

In an alternative embodiment modified from the embodiment of FIG. 4C and the embodiment of FIG. 9A, which is schematically illustrated in FIG. 9B, the second sleeve 302 with hook posts 3010 and the fourth sleeve 304 with loop posts 3020 are omitted, and the corresponding ends 102 and 202 of the base member 10 and holding member 20 are jointed in another way instead of the hook-and-loop fastener manner. Further examples of the jointing ways between the base member 10 and holding member 20 can be referred to the parent U.S. patent application Ser. No. 15/842,873, contents of which are incorporated herein for reference. In this embodiment, the base member 10 and the holding member 20 may form a closed loop and hair is inserted into the space 97 from an opening of the closed loop, or the ends 101 and 201 of the base member 10 and holding member 20 can be opened to receive hair therefrom, and then closed with the hook posts 3010 and loop posts 3020. Likewise, the hook-and-loop fastener is merely an example of the attaching member, and may be replaced with other engaging/disengaging means, e.g. magnetic sets with different polarities.

Figure 10A:
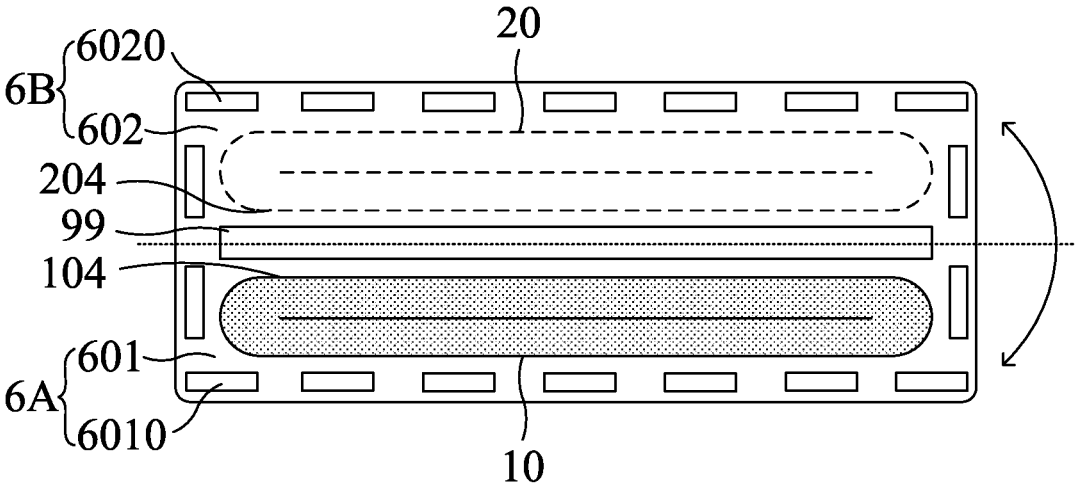
FIG. 10A is a schematic diagram which illustrates a hair styling device according to a further embodiment of the present invention.

FIG. 10A schematically illustrates another embodiment of hair styling tool according to the present invention. In this amendment, the attaching member includes a first part 6A and a second part 6B, wherein the first part 6A includes a supporting base 601 formed with a plurality of magnetic pieces 6010 attached onto the base member 10, and the second part 6B includes a supporting base 602 formed with a plurality of magnetic pieces 6020 attached onto the holding member 20. The supporting base 601 may be wrapped around the base member 10, and the supporting base 602 may be wrapped around the holding member 20. The base member 10 and the holding member 20 may be made of the same or different material. For example, the holding member 20 may also be made of metal, metallic material, plastic material or any other suitable material that has two stable states similar to the base member 10. In this embodiment, the base member 10 and the holding member 20 are connected to each other by longitudinal sides 104 and 204 thereof instead of or in addition to their longitudinal ends 101/102 and 201/202. More specifically, the supporting base 601 and the supporting base 602 are integrally formed as a single piece of material. An opening 99 is disposed between the supporting base 601 and the supporting base 602 for receiving therefrom hair, and the supporting base 602 can be folded to overlap with the supporting base 601 after hair is inserted from the opening 99. The magnetic pieces 6010 and the magnetic pieces 6020 are of different polarities and attract each other to stably clamp hair in the space between the base member 10 and the holding member 20. Afterwards, hair can be rolled up with the base member 10 and the holding member 20 to style hair. Alternatively, the magnetic pieces 6010 and the magnetic pieces 6020 may be replaced with hook posts and loop posts as mentioned above, which are coupled to each other to clamp hair therebetween.

Figure 10B:
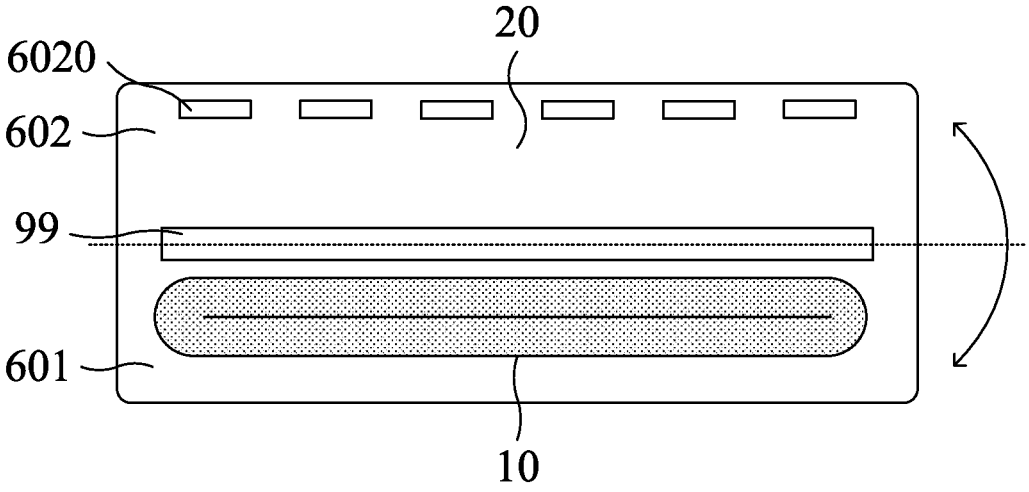
FIG. 10B is a schematic diagram which illustrates a hair styling device according to a further embodiment of the present invention.

FIG. 10B schematically illustrates an alternative embodiment of the hair styling tool according to the present invention, which is similar to and modified from the hair styling tool shown in FIG. 10A. In this embodiment, the base member 10 is made of a metallic material, and the supporting base 602 is used not only for disposing the magnetic pieces 6020 but also serving as the holding member. The supporting base 602 can be folded to overlap with the supporting base 601 before or after hair is inserted from the opening 99, and the magnetic pieces 6020 is coupled to the metallic base member 10 to stabilize the well-distributed hair before rolling up. Similar variations can be made as described with reference to FIG. 10A, and are not to be redundantly described herein.

In an alternative embodiment modified from the embodiment shown in FIG. 10A, the magnetic pieces 6010 and 6020 (or hook/loop posts) arranged at the longitudinal sides, i.e. arranged in parallel to the base member 10 and holding member 20, are omitted. In other words, magnetic pieces 6010 and 6020 (or hook/loop posts) are only disposed at longitudinal ends of the base member 10 and holding member 20. Meanwhile, the supporting base 601 and the supporting base 602 are connected to each other or integrally formed as a single piece of material with the opening 99 remained for passing therethough hair.

Figure 11A:
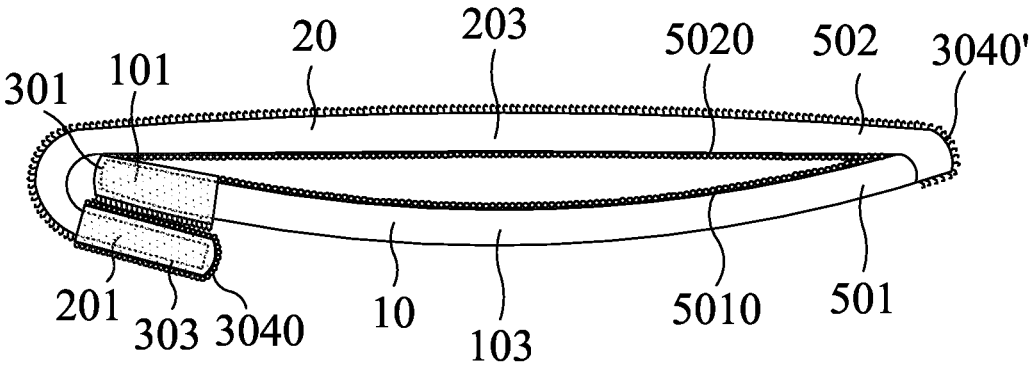
FIG. 11A is a schematic diagram which illustrates a hair styling device according to a further embodiment of the present invention.
Figure 11B:
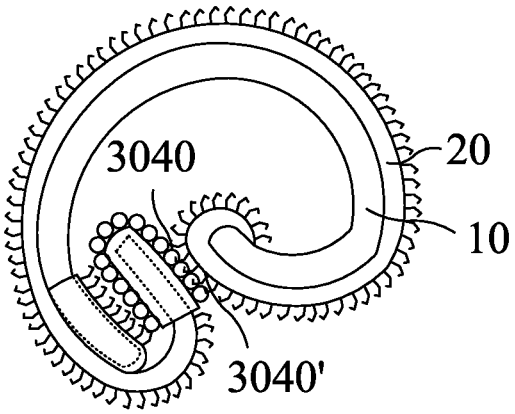
FIG. 11B is a side view schematically illustrating the hair styling device of FIG. 11A, which has a securing member for securing the second stable state where the base member has a wrap-around cylindrical structure coiled around lateral axis where the curved ridge disappears.

Further referring to a further embodiment illustrated in FIGS. 11A and 11B, which are modified from the embodiment illustrated in FIG. 9B. By properly arranging hook/loop posts 3040 and 3040' on the holding member at opposite ends, the second stable state, where the base member 10 has a wrap-around cylindrical structure coiled around lateral axis where the curved ridge disappears, may be secured with the engagement of the hook/loop posts 3040 and 3040'. In this embodiment, the mini-posts 5010 and 5020 for interacting with hair to smooth hair when penetrating through hair may be both or either provided or omitted. The hook-and-loop fastener is merely an example of the securing member, and may be replaced with other engaging/disengaging means, e.g. magnetic sets with different polarities.

Figure 12A:
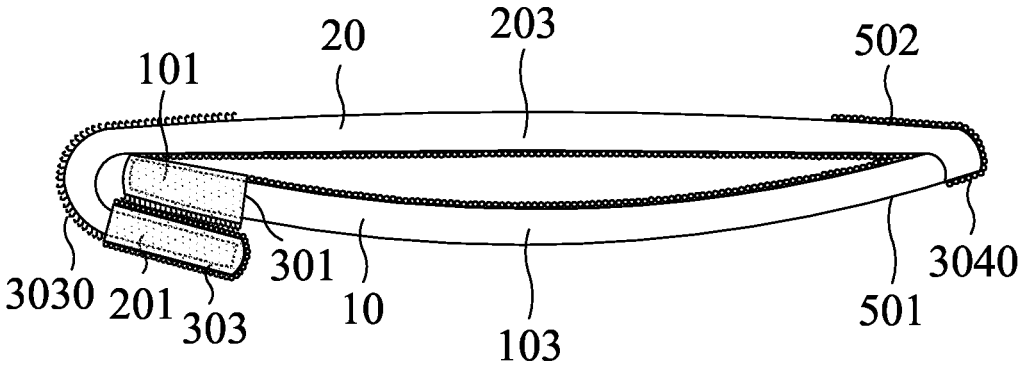
FIG. 12A is a side view schematically illustrating an alternative example similar to the hair styling device of FIG. 11A but having a securing member for securing the second stable state where the base member has at least one wrap-around cylindrical structure coiled around lateral axis where the curved ridge disappears.
Figure 12B:
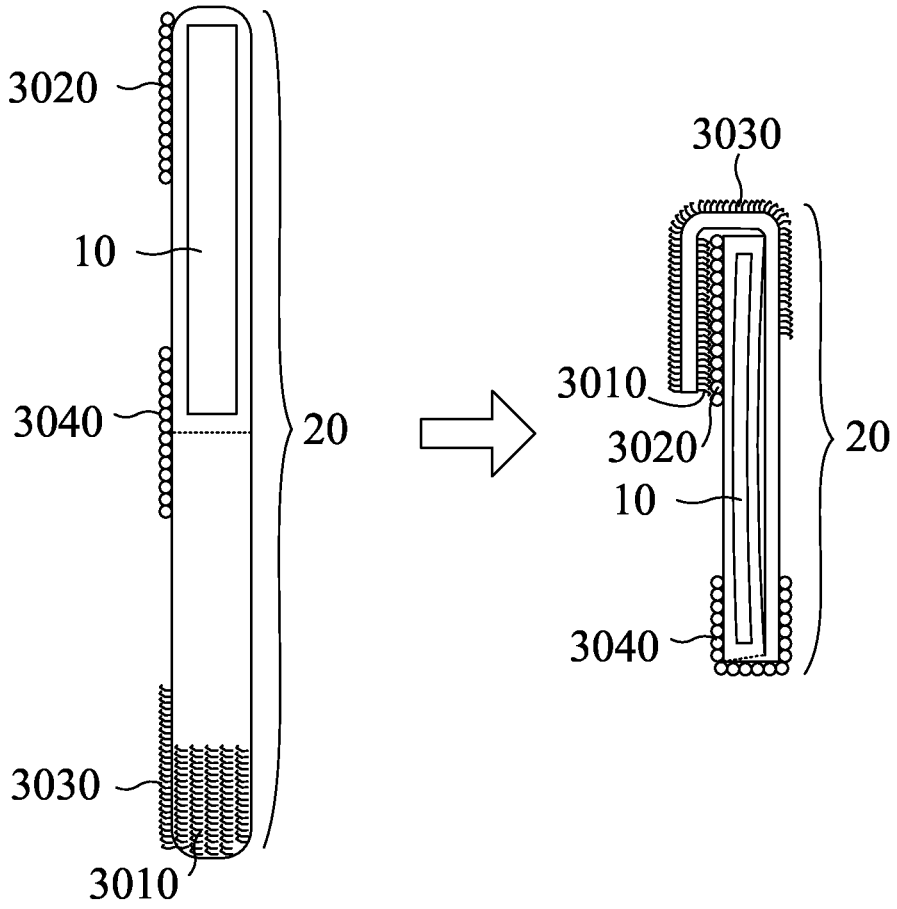
FIG. 12B is a scheme exemplifying how the hair styling device of FIG. 11A can be formed.

FIG. 12A illustrates a further embodiment of a hair styling device according to the present invention, and FIG. 12B schematically exemplifies the formation of the hair styling device of FIG. 12A. In this embodiment, a base member 10 is attached to or wrapped by an elongated holding member 20. The holding member 20 is folded to have one end thereof, which is disposed with mini-posts 3010, engage with mini-posts 3020 (partially shown) disposed at the other end of the holding member 20 and underlying the base member 10, thereby form a closed loop with none, one or both ends able to be opened for receiving hair therein. As described above, after hair is clamped into the space 97, the entire device can be wrapped around, and meanwhile, the mini-posts 3030 and 3040 engage with each other to secure the second stable state.

It is to be noted that in the above embodiments, the first part 3A/5A includes hook posts and the second part 3B/5B includes loop posts. Alternatively, the first part 3A/5A may include loop posts and the second part 3B/5B includes hook post. The first part 3A/5A and the second part 3B/5B may also have mixed hook and loop posts as long as they can be successfully engaged with each other. Moreover, the above-mentioned sleeves are only examples for attaching the hook and/or loop posts onto the base member and the holding member, and can be replaced with supporting sheets, which are, for example, glued, taped or sewn onto the base member and the holding member. The hook and/or loop posts can also be provided onto the base member and the holding member in any other proper way with or without the supporting bases.

For further improving hair-smoothing and hair-styling performance, it is preferred that the hair styling device can release heat to hair. For achieving this purpose, the base member 10 is preferably made of a heat-conducting material, which retains heat when heated by an external heat source, e.g. hair dryer, microwave, oven, electricity, steam, sun, induction, or any other suitable heating source, and dissipates heat to hair inserted between the base member and the holding member. The material that is suitable to be used to form the base member 10 includes, for example, a metal or a metallic material.

Figure 13A:
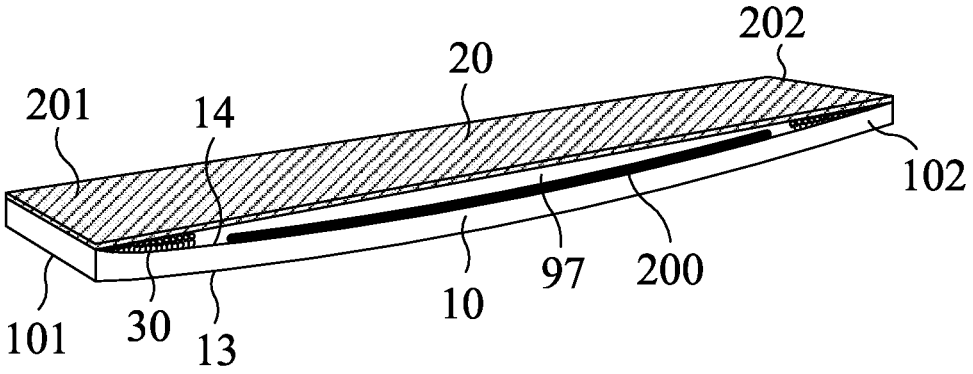
FIG. 13A is a schematic diagram which illustrates a hair styling device according to still another embodiment of the present invention.
Figure 13B:
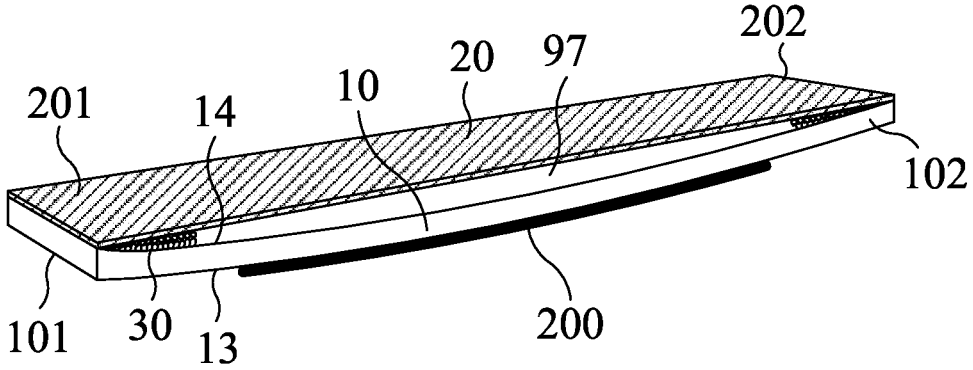
FIG. 13B is a schematic diagram which illustrates a hair styling device according to still a further embodiment of the present invention.

In an alternative embodiment, the hair styling device is similar to any of the embodiments described above (taking the embodiment as illustrated in FIG. 3A as an example herein) and further comprises a heater material 200 disposed adjacent to the base member 10 for dissipating heat to hair when hair is inserted between the base member 10 and the holding member 20. The heater material 200 can spontaneously dissipate heat and/or be heated after being placed in the hair styling device, as illustrated in FIG. 13A or FIG. 13B. In the embodiment shown in FIG. 13A, the heater material 200 is disposed on the surface 14 of the base member 10, facing the holding member 20; and in the embodiment shown in FIG. 13B, the heater material 200 is disposed on the surface 13 of the base member 10, away from the holding member 20. To avoid overheat, a heat-buffering material, e.g. silicon, may be sleeved around the base member 10 with the heater material 200. The heater material 200, for example, may be a sheet of ceramic, copper, aluminum, titanium, foil, iron, steel, carbon fiber, fiber glass, ceramic, clay, magnesium or metallic material, or a heating bag. The materials applicable in a reflective foil technology, such as heat-reflective aluminum film coated fiber glass fabric or cloth, a ceramic fiber paper, PTFE (Polytetrafluoroethylene) rope with graphite coating, weld backing tape, etc., may also be used in the invention as the heater material 200.

Figure 14:
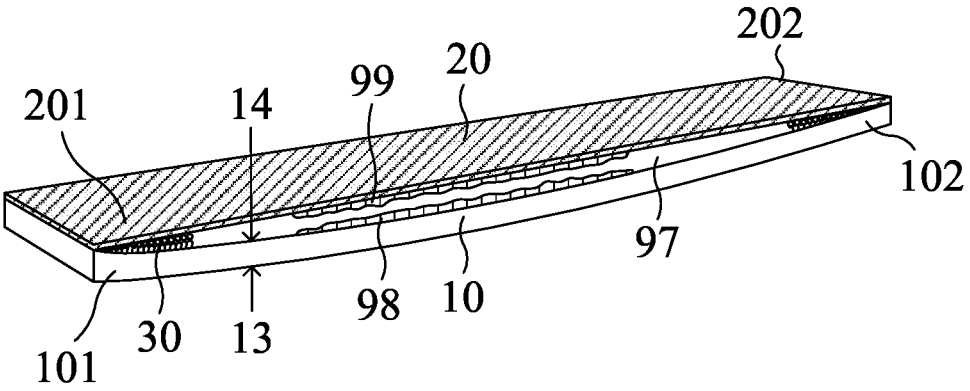
FIG. 14 is a schematic diagram which illustrates a hair styling device according to still a further embodiment of the present invention.

In a further embodiment as illustrated in FIG. 14, the hair smoothing device is similar to any of the embodiments described above (taking the embodiment as illustrated in FIG. 3A as an example herein) and the base member 10 further comprises a gripping portion 98 to improve the positioning and retention of hair. Materials with properties suitable to improve the positioning and holding of hair, such as silicone, rubber, synthetic wig or anti-slippage material may be affixed, or otherwise added, to either, or both, the base member or holding member. The holding member further comprises a gripping portion 99 to improve the positioning and retention of hair. Materials with properties suitable to improve the positioning and holding of hair, such as silicone, rubber, synthetic wig or anti-slippage material may be affixed, or otherwise added, to either, or both, the base member 10 or holding member 20. The gripping portion 98 and the gripping portion 99 may coexist with the hook/loop posts in the middle portions 103 and 203 of the base member 10 and holding member 20.

Decorative materials such as fabric, leather, flannel woven, plush, sequin, velvet, silk, polyester, Polyester, nylon, satin, PVC prismatic reflective sheet, vinyl, polyethylene, polythene or other may be added to either the base member 10 or the holding member 20 for aesthetic considerations to improve the visual attractiveness for the user or 'feel' of the device when touched by the user, while the hook/loop posts are exposed to be in contact with hair.

There are number of ways to use the hair styling device. Two simple methods of usage are provided below as examples of how the hair styling device can be employed to achieve top-knot, low bun, updo, ponytail or other type hair styles.

Uncoiled the hair styling device as it is in the first state of the base member where the hair styling device stays straight. Put a bundle of hair through the closed loop of the hair styling device where the base member is on the bottom facing wearer's nape. Spread the hair out evenly across the concave surface. Slide the hair device toward to the tip of the hair. Further, roll away from the neck from the bottom of the device and fold the hair styling device with restraining hair by flipping them along the hair upward to the root of the hair until desired length of the hair with the concave surface of the base member facing upward. Applying force to at least one point of the base member to bend the ends of the convex side of the base member downward to snap and capture the bundle of hair into the second state of the base member. The hair device will form a circle or two small circles. The wearer can adjust the hair to cover the exposing portion of the hair styling device to make perfect style.

A second styling method begins by positioning the device identically to above. In this example, the bottom of the device is rolled towards the neck (opposite direction of rolling in the first example). Hair is rolled and folded by the rolling of the hair styling device which restrains hair as the device is rolled toward the root of the hair until the desired length of the hair is achieved with the concave surface of the base member facing downward, rather than upward as in the first example. Applying force to at least one point of the base member to bend the ends of the convex side of the base member upward to snap and capture the bundle of hair into the second state of the base member. The hair styling device will form a circle or two small circles. The wearer can adjust the hair to cover the exposed portion of the hair styling device to make a perfect style.

Furthermore, the hair styling device according to the invention, if made of a proper material with a proper size, can be used as a hair roller.

It is to be noted that the above embodiments and examples are only given for better understanding the invention, but should not be used for confining the implementations of the invention. Various modifications and similar arrangements are covered and included within the spirit and scope of the claims which are to be accorded with the broadest interpretation so as to encompass all such modifications and similar structures.

What is claimed:

1. A hair styling device, comprising:

a) a base member comprising a first surface and an opposing second surface; the base member having two mechanical shapes stabilized in a first stable state and a second stable state, wherein in the first stable state, the base member has a linear structure including two terminal ends in a longitudinal direction, and having a curved ridge extending in the longitudinal direction between the two terminal ends, and in the second stable state, the base member has at least one wrap-around cylindrical structure, which is coiled around an axis while flattening the curved ridge;

b) a holding member made of a pliable material and having opposing top and bottom surfaces, wherein the bottom surface of the holding member faces the first surface of the base member and detachably secured to the second surface of the base member at one or both of the terminal ends of the base member to form a space for receiving hair of a user therebetween; and c) an attaching member including a first part and a second part; in an assembled position, the first part being coupled to the base member and the second part being coupled to the holding member so as to secure face-to-face attachment of the bottom surface of the holding member to the second surface of the base member at one or both of the terminal ends, thereby facilitating alignment of the holding member with the base member while placing the hair of the user in the space.

2. The hair styling device as recited in claim 1, wherein the first part and the second part of the attaching member include different ones of hook posts and loop posts, which are engageable with each other.

3. The hair styling device as recited in claim 1, wherein the first part and the second part of the attaching member include magnetic sets of different polarities, which are engageable with each other.

4. The hair styling device as recited in claim 1, wherein a plurality of hair-smoothing hook and/or loop posts are attached onto a middle portion of the base member, and/or a middle portion of the holding member.

5. The hair styling device as recited in claim 1, wherein a gripping portion is attached onto a middle portion of the base member, and/or a middle portion of the holding member to improve the positioning and retention of hair.

6. The hair styling device as recited in claim 1, wherein the second part of the attaching member is integrally formed with the holding member.

7. The hair styling device as recited in claim 1, wherein the first part of the attaching member further includes a supporting base formed thereon with mini-posts and/or magnetic pieces.

8. The hair styling device as recited in claim 1, wherein the second part of the attaching member include a magnetic set, and the first part of the attaching member is integrated with the base member when the base member is made of a metallic material.

9. The hair styling device as recited in claim 1, wherein each of the first and second parts of the attaching member further includes a supporting base formed thereon with mini-posts and/or magnetic sets coupled to the corresponding base member or holding member.

10. The hair styling device as recited in claim 9, wherein the supporting base of the second part of the attaching member includes at least one sleeve, where the mini-posts and/or magnetic set are formed, and wherein the at least one sleeve is put on at least one of the terminal ends of the holding member.

11. The hair styling device as recited in claim 1, further comprising a securing member for securing the second stable state, wherein the securing member includes a first portion of mini-posts and/or a magnetic set disposed on the second surface of the base member and/or the first part of the attaching member, and a second portion of mini-posts and/or a magnetic set disposed on the top surface of the holding member and/or the second part of the attaching member.

12. The hair styling device as recited in claim 1, further comprising a securing member for securing the second stable state, wherein the securing member includes a plurality of mini-posts and/or a magnetic set disposed on the top surface of the holding member and/or the second part of the attaching member at both of the terminal ends.

13. The hair styling device as recited in claim 1, further comprising a heater material disposed adjacent to the base member for dissipating heat to hair inserted between the base member and the holding member.

* * * * *